US010559165B1

(12) United States Patent
Kelley et al.

(10) Patent No.: US 10,559,165 B1
(45) Date of Patent: Feb. 11, 2020

(54) COMBINATION BILL ENTRY/TICKET DISPENSING STRUCTURE FOR A GAMING MACHINE

(71) Applicant: Bally Gaming, Inc., Las Vegas, NV (US)

(72) Inventors: Timothy Kelley, Reno, NV (US); Gordon H. Myers, Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 16/146,684

(22) Filed: Sep. 28, 2018

(51) Int. Cl.
*G07F 17/32* (2006.01)
*G07B 1/00* (2006.01)
*G06Q 50/34* (2012.01)

(52) U.S. Cl.
CPC ..... *G07F 17/3246* (2013.01); *G06Q 50/34* (2013.01); *G07B 1/00* (2013.01); *G07F 17/3209* (2013.01); *G07F 17/3216* (2013.01)

(58) Field of Classification Search
CPC ..... G07F 17/3202; G07F 17/3209; G07F 17/3216; G07F 17/3241; G07F 17/3246; G07F 17/326
See application file for complete search history.

(56) References Cited

U.S. PATENT DOCUMENTS 5,332,076 A 7/1994 Ziegert
5,377,994 A 1/1995 Jones
5,386,903 A 2/1995 Rothschild et al.
5,542,669 A 8/1996 Charron et al.
5,803,809 A 9/1998 Yoseloff
6,126,542 A 10/2000 Fier
6,264,556 B1 7/2001 Izawa et al.
6,628,939 B2 9/2003 Paulsen
6,688,984 B2 2/2004 Cole
6,843,720 B2 1/2005 Luciano et al.
6,991,539 B2 1/2006 Pacey
7,419,430 B1 9/2008 Joshi et al.
7,494,414 B2 2/2009 Hedrick et al.
7,699,698 B2 4/2010 Randall
7,922,587 B2 4/2011 Chun
9,711,002 B2 7/2017 Peltz et al.
2002/0058542 A1 5/2002 Roethel et al.
2003/0125105 A1 7/2003 Bennett
2003/0189290 A1 10/2003 Moody
2004/0053698 A1 3/2004 Tastad et al.
(Continued)

OTHER PUBLICATIONS

"G2O Bar Top" Brochure, 2011, IGT, 1 page.

*Primary Examiner* — Omkar A Deodhar
(74) *Attorney, Agent, or Firm* — Marvin A. Hein

(57) ABSTRACT

Disclosed are an input/output structure, a gaming machine including such a structure and a method for use of the input/output structure. The input/output structure includes first and second chutes disposed beneath a surface of the input/output structure with an elongated output port configured to dispense a first ticket from a printer through the first chute and onto the surface and an elongated input port directly adjacent and generally orthogonal to the output port and coupled to the second chute to accept and lead at least one of currency or a second ticket into the second chute and further into a bill acceptor. The method includes the steps of dispensing a first ticket from the output port and onto the surface above the first chute and of accepting at least one of currency or a second ticket into the input port and then the second chute.

19 Claims, 7 Drawing Sheets

(56) References Cited

U.S. PATENT DOCUMENTS

| | | | |
|---|---|---|---|
| 2004/0092316 | A1 | 5/2004 | Nagano |
| 2004/0142752 | A1 | 7/2004 | Gauselmann |
| 2005/0266917 | A1 | 12/2005 | Glavich et al. |
| 2005/0282627 | A1 | 12/2005 | Hedrick et al. |
| 2006/0019747 | A1 | 1/2006 | Loose et al. |
| 2006/0035694 | A1 | 2/2006 | Fuller |
| 2006/0166741 | A1 | 7/2006 | Boyd et al. |
| 2007/0275777 | A1 | 11/2007 | Walker et al. |
| 2008/0026822 | A1 | 1/2008 | Walker et al. |
| 2008/0153580 | A1 | 6/2008 | Beadell et al. |
| 2008/0153581 | A1 | 6/2008 | Hedrick et al. |
| 2009/0111562 | A1 | 4/2009 | Chudd et al. |
| 2009/0221375 | A1 | 9/2009 | Luciano, Jr. et al. |
| 2010/0075746 | A1 | 3/2010 | Anderson et al. |
| 2010/0267439 | A1 | 10/2010 | Englman et al. |

COMBINATION BILL ENTRY/TICKET DISPENSING STRUCTURE FOR A GAMING MACHINE

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to a combination bill entry/ticket dispensing structure for a gaming machine.

BACKGROUND OF THE INVENTION

This invention relates to gaming machine cabinets and, more particularly, to an gaming machine cabinet having a combination bill entry/ticket dispensing structure for both receiving and dispensing currency and/or various currency representative media.

Traditional gaming machines include one input port for receiving currency or other credit-adding media, and another, separate, output port for dispensing winnings in some form. This is often confusing for a player, who may incorrectly attempt to insert currency into the output port, and/or conversely try to locate cashed-out winnings from the input port, which will be empty. Recently, some gaming machines have featured a single port for both the reception of and the dispensing of currency or the like. This not only avoids player confusion, but also frees up extra space on the face of the cabinet for other components or uses. One example may be found in co-owned U.S. Pat. No. 9,711,002, "Upright Gaming Machine Having a Dual Chute," incorporated by reference in its entirety. However, such an arrangement typically requires the internal stacking of bulky components, such as a bill acceptor and a printer, so that they may be coupled to the same port. Some gaming machine cabinets may not have sufficient internal vertical space to allow such stacking of these components. A bill entry/ticket dispensing structure that offers the ease of use and space-saving features of a single location for acceptance of bills and the dispensing of tickets, while also eliminating the need to stack internal components, thus minimizing the internal cabinet depth requirement, would be a stark improvement in the field of gaming.

SUMMARY OF THE INVENTION

Briefly, and in general terms, the present invention provides an input/output structure including first and second chutes disposed beneath a surface, an elongated output port configured to dispense a first ticket through the first chute onto the surface. The structure also includes an elongated input port immediately adjacent and generally orthogonal to the output port and coupled to the second chute. The input port is configured to accept and lead at least one of currency or a second ticket into the second chute. The first chute is typically coupled to a ticket dispenser, the second chute is typically coupled to a bill acceptor.

In accordance with one or more other embodiments, a gaming device includes a housing including a deck; an electronic display mounted to the housing and configured to present a wagering game; and an input/output structure mounted to the deck, the input/output structure includes first and second chutes disposed beneath a surface generally parallel to the deck, an elongated output port and an elongated input port. The elongated output port is configured to dispense a first ticket through the first chute onto the surface. The elongated input port is immediately adjacent and generally orthogonal to the output port and coupled to the second chute. It is configured to accept and lead at least one of currency or a second ticket into the second chute. The first chute is typically coupled to a ticket dispenser, the second chute is typically coupled to a bill acceptor.

In accordance with one or more embodiments, a method of using an input/output structure, the input/output structure including first and second chutes, an elongated output port coupled to the first chute, and an elongated input port immediately adjacent and generally orthogonal to the output port and coupled to the second chute includes the steps of dispensing a first ticket from the output port onto a surface above the first chute and accepting at least one of currency or a second ticket into the input port and then into the second chute. The first chute is typically coupled to a ticket dispenser, the second chute is typically coupled to a bill acceptor.

Additional aspects of the invention will be apparent to those of ordinary skill in the art in view of the detailed description of various embodiments, which is made with reference to the drawings, a brief description of which is provided below.

Figure 1:
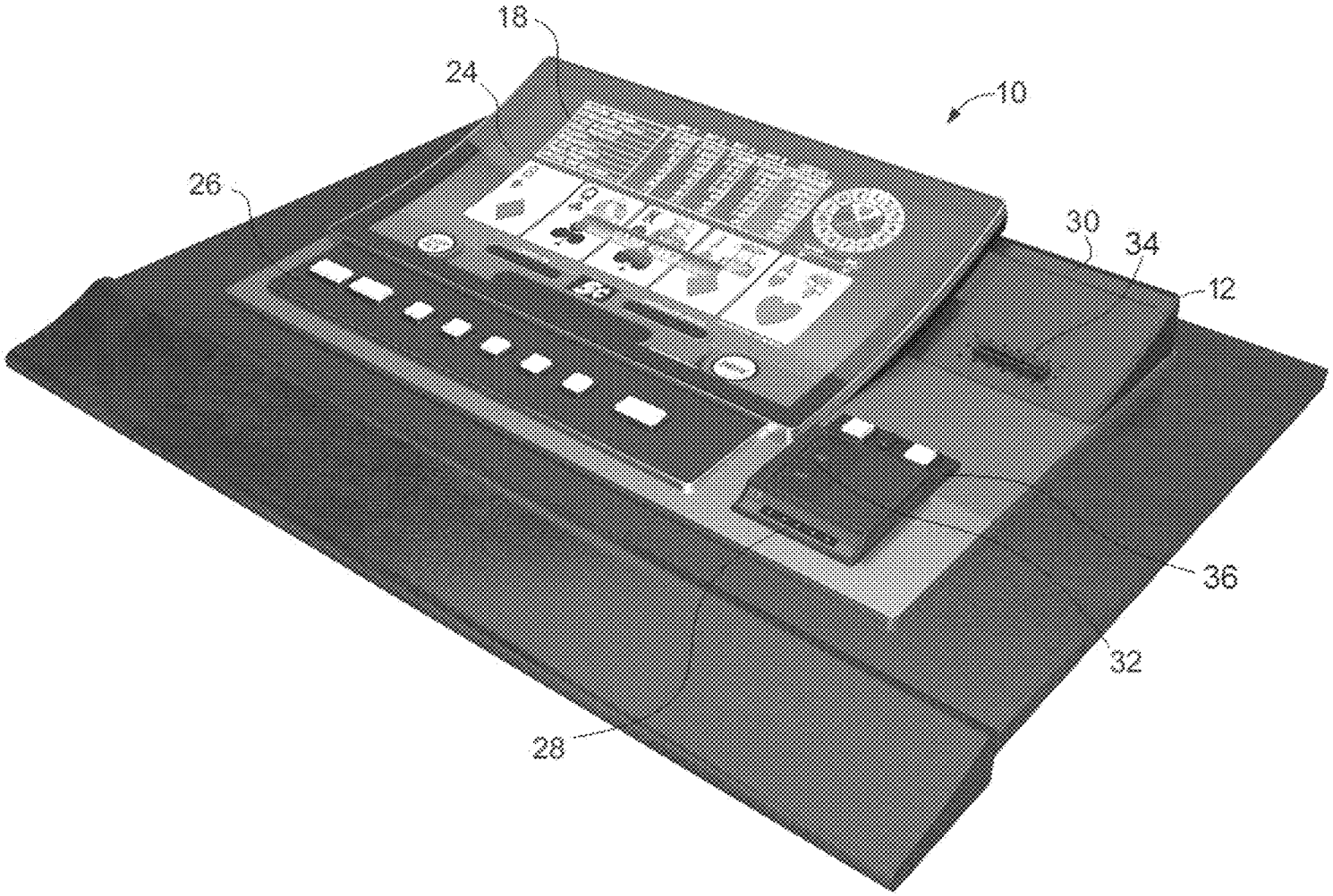
FIG. 1 is an isometric view of a gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

The term "bill acceptor" includes any device which accepts bills, currency, coupons, tickets or the like which represent value. The term "ticket dispenser" includes any devices which dispense tickets, coupons and the like, whether pre-printed or printed by the ticket dispenser (such as a ticket printer).

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may or may not be primarily dedicated for use in playing wagering games. An exemplary type of gaming machine is disclosed in U.S. Pat. No. 6,517,433, which is incorporated herein by reference in its entirety.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more top or front doors that are locked and require a physical or electronic key to gain access to the interior compartment of the cabinet 12 behind the locked door.

The input devices, output devices, and input/output devices are disposed on, and securely coupled to, the cabinet 12. By way of example, the output devices include a primary display 18, and one or more audio speakers (not shown). The primary display 18 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen 24 mounted over the primary display, a button panel 26, which may comprise physical button switches (as shown) or a touch-based button panel such as an iDeck® by Bally Gaming, a bill/ticket input port 28, a player tracking system panel 30 which may include a card reader/writer 34, a ticket output port 32, and player-accessible ports (e.g., audio output jack for headphones, video headset jack, USB port, wireless transmitter/receiver, etc., not shown). It should be understood that numerous other peripheral devices and other elements exist and are readily utilizable in any number of combinations to create various forms of a gaming machine in accord with the present concepts.

The player input devices, such as the touch screen 24, button panel 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are used to fund wagers placed on the wagering game played via the gaming machine 10. Examples of value input devices include, but are not limited to, a coin acceptor, a bill acceptor coupled to input port 28, the card reader/writer 34, a wireless communication interface for reading cash or credit data from a nearby mobile device, and a network interface for withdrawing cash or credits from a remote account via an electronic funds transfer. The value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 34, a ticket dispenser/dispenser coupled to output port 32 for printing tickets redeemable for cash or credits, a wireless communication interface for transmitting cash or credit data to a nearby mobile device, and a network interface for depositing cash or credits to a remote account via an electronic funds transfer. Access to the value input/payment devices and value output/payout devices may be through a common bill entry/ticket dispensing structure 36.

Figure 2:
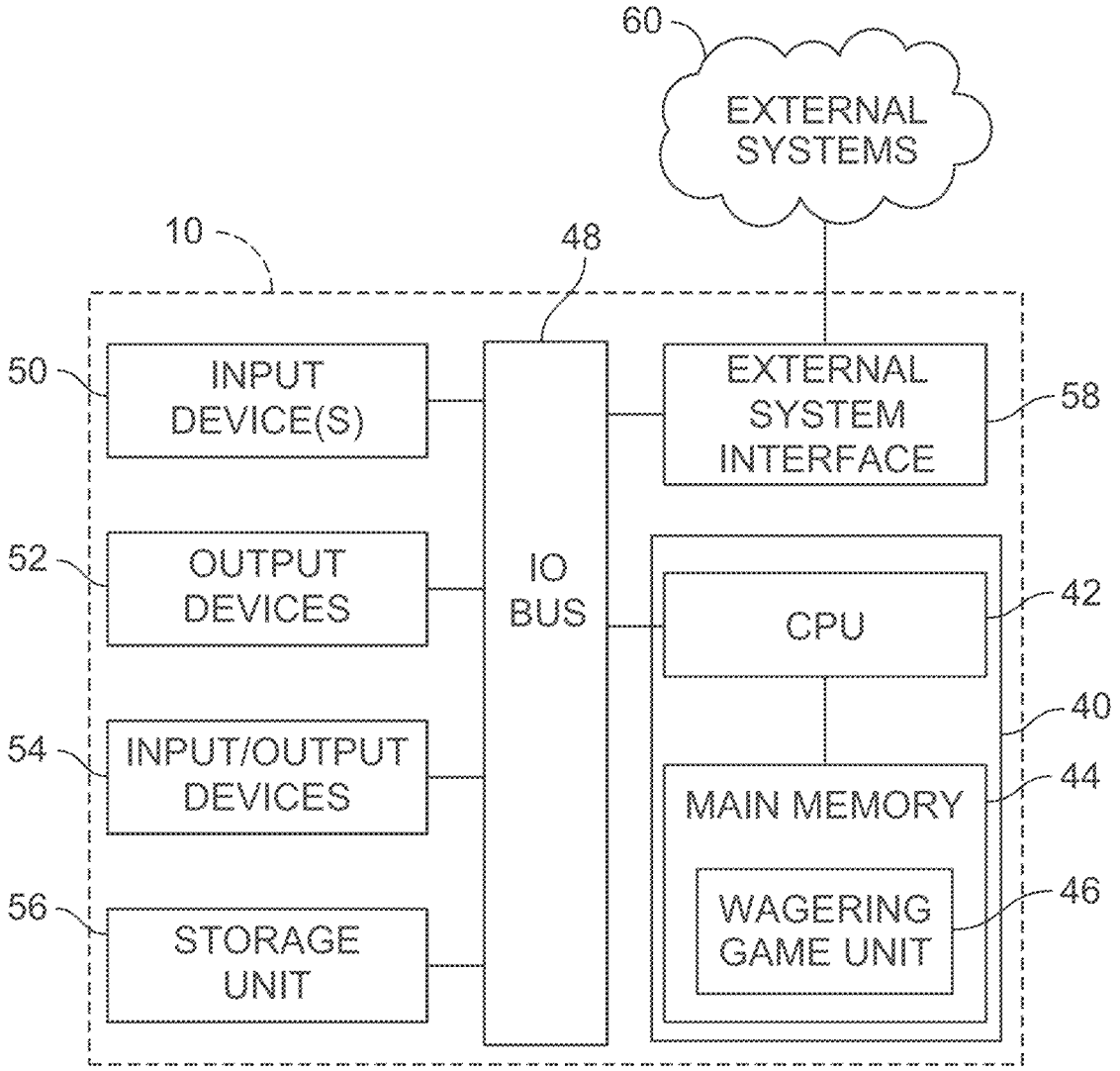
FIG. 2 is a schematic view of a gaming system including the gaming machine.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD.

By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compares it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
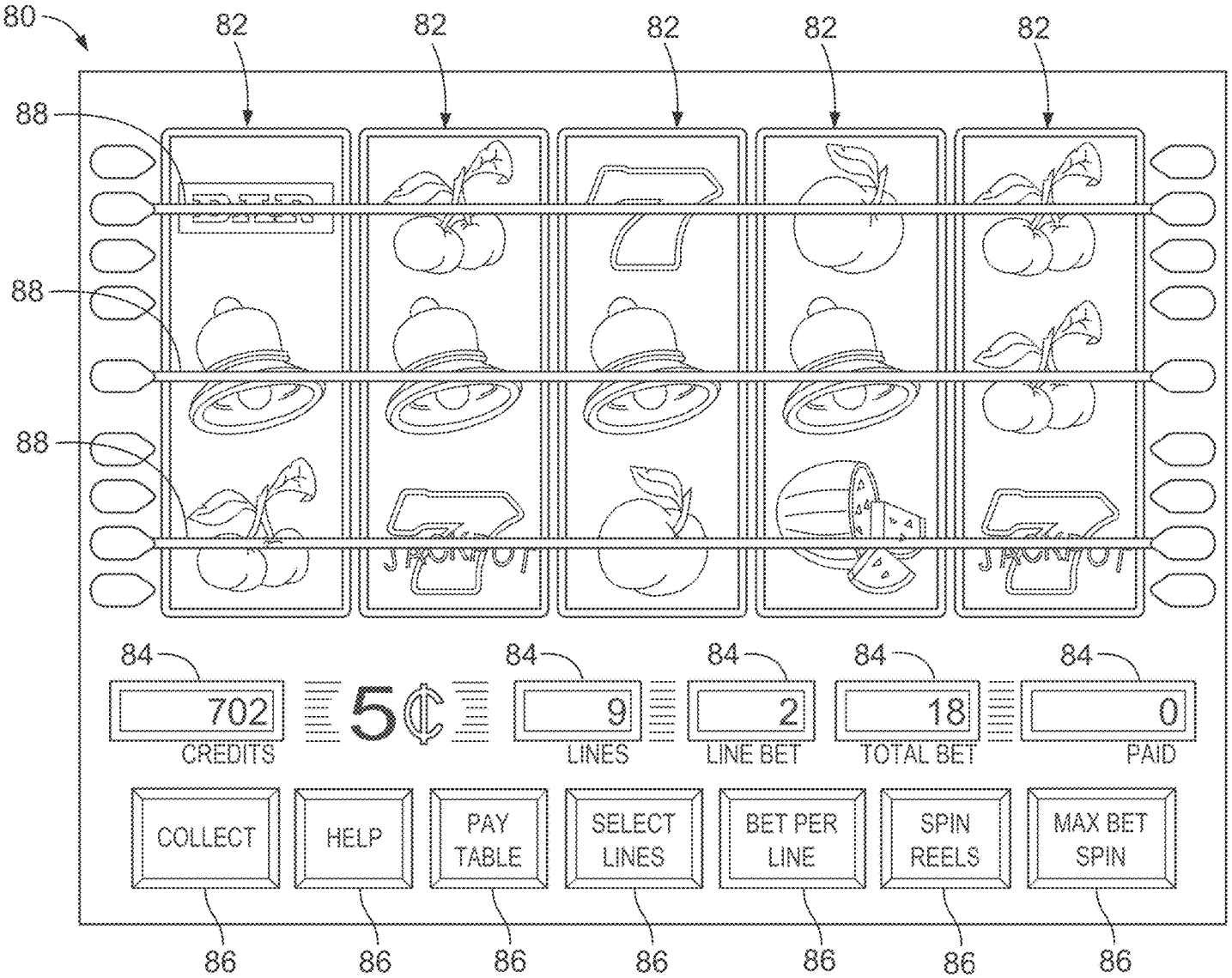
FIG. 3 is an image of an exemplary basic-game screen of a wagering game displayed on the gaming machine.

Referring now to FIG. 3, there is illustrated an image of a basic-game screen 80 adapted to be displayed on the primary display 18. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 to display the wagering game.

In response to receiving an input indicative of a wager, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4A:
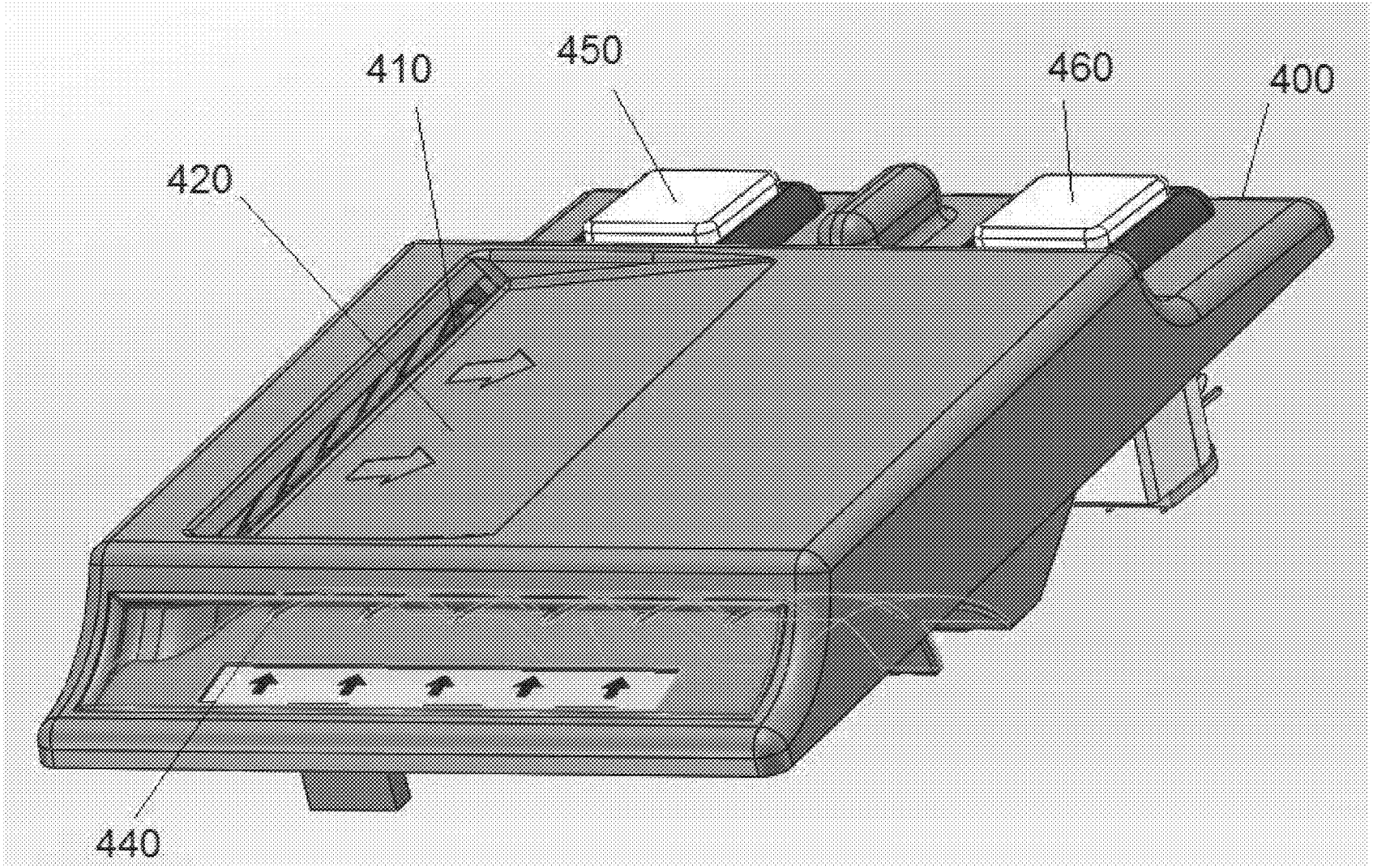
FIGS. 4A and 4B offer isometric views of an example of a combination bill entry/ticket dispensing structure in accordance with one or more embodiments.
Figure 4B:
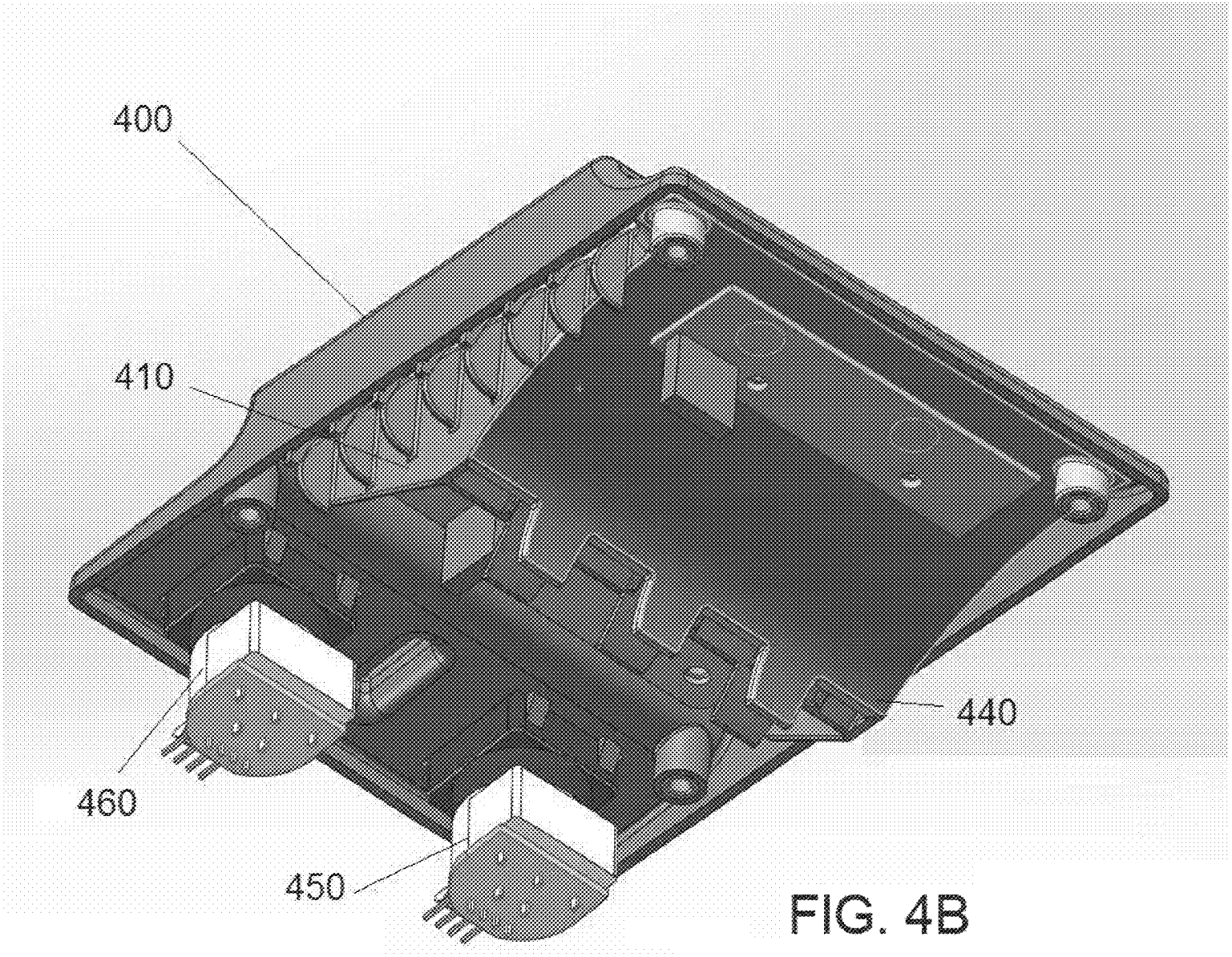
Figure 5:
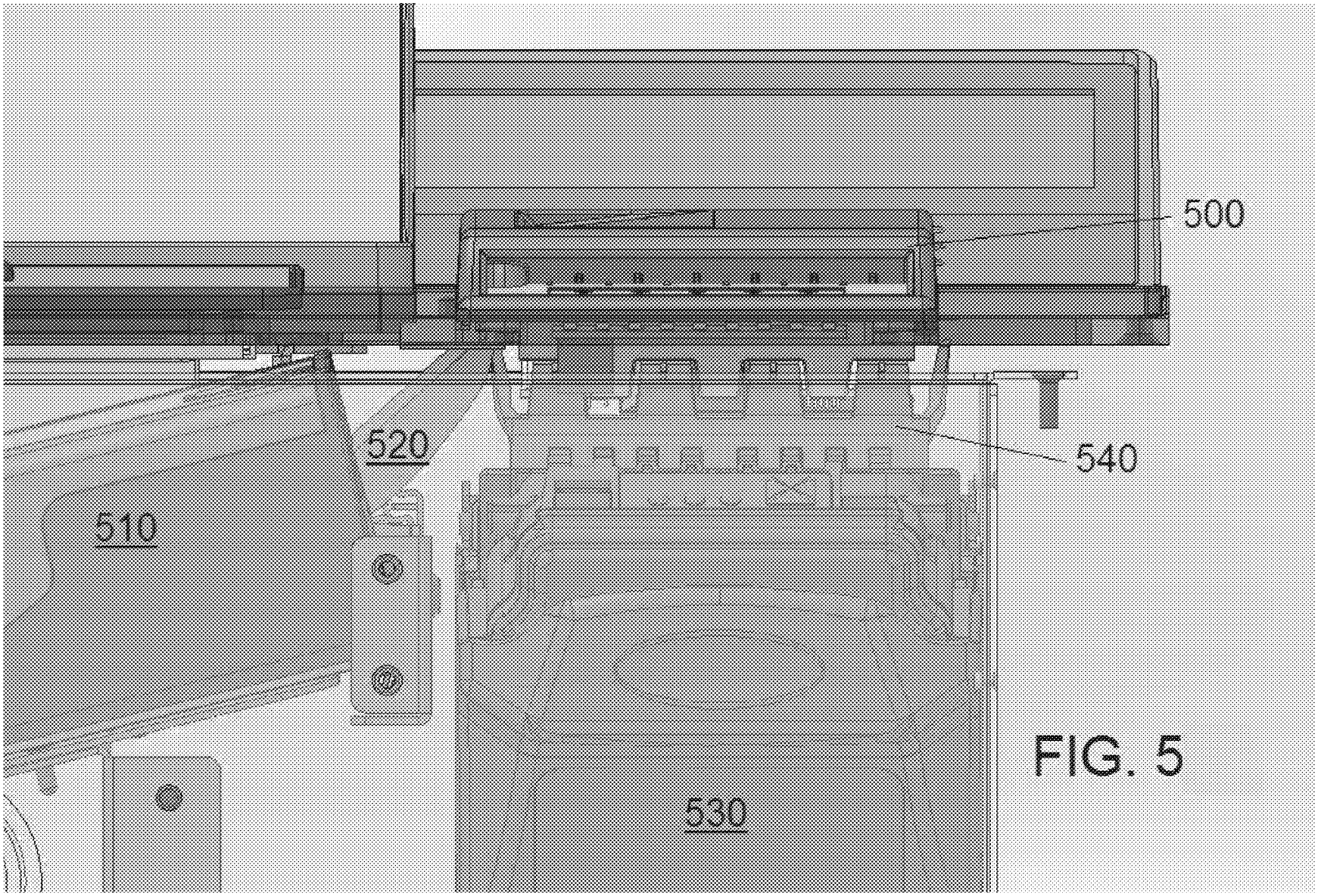
FIG. 5 provides an illustration of components within a cabinet of the gaming machine of FIG. 1 that are associated with the combination bill entry/ticket dispensing structure of FIGS. 4A and 4B.

Referring now to FIGS. 4A-4B and FIG. 5, in accordance with one or more embodiments, an input/output structure 400 (also FIG. 5, 500) including an elongated output port 410 configured to dispense a first ticket from a ticket dispenser 510 via a first chute 520 mated to the ticket dispenser 510, both internal to the gaming machine, onto the external surface 420. The surface 420 may form an upward ramp extending from the output port 410.

The input/output structure 400 also includes an elongated input port 440 immediately adjacent to and generally orthogonal to the output port 410. The input port 440 is configured to accept and lead at least one of currency or a second ticket into a second chute 540 mated to a currency/bill acceptor 530 beneath the deck and internal to the gaming machine. The second chute 540 may be curved or angled downward to direct the currency or the second ticket to the bill acceptor 530.

The input/output structure may include one or more buttons, for example, buttons 450 and 460, electrically coupled to the gaming machine as input devices (FIG. 2, 50) either related or unrelated to functions associated with the input/output structure 400. For example, button 450 may serve as a cashout button which triggers the dispensing of the first ticket (related), while button 460 may serve as an attendant call button (unrelated).

As an example, in accordance with one or more embodiments, the output port 410 and the surface 420 may be formed by a first component and the input port may be formed by a second component, with the second component may be mounted within the first component. The first and second components may be formed or constructed of any suitable material. For example, the components may comprise injection-molded plastic. The components may be fastened together by any suitable means, for example, by screws, glue, plastic cement or other adhesives, vibration welding, etc. In accordance with one or more other embodiments, the input/output structure may be formed as a monolithic component or by greater than two components.

In the example of the bartop gaming machine illustrated by FIG. 1, in contrast to the use of separate input and output structures of approximately the same dimension as the single bill entry/ticket dispensing structure 36, it can be seen that the immediately adjacent placement of the input port 28 and the output port 32 as elements of a single bill entry/ticket dispensing structure 36 doubles the available real estate on the surface of the gaming machine. In the example of FIG. 1, space is thus available for use by a patron to place a glass, an ashtray or other objects in the area between the bill entry/ticket dispensing structure 36 and the player tracking system panel 30.

The orthogonal arrangement of the input and output ports serves to avoid player confusion over which port to use for the insertion of currency. For example, in the embodiment shown in FIG. 1, the input port 28 is oriented to face the patron. The output port 32 is oriented 90 degrees away from the patron and is largely concealed from the patron, its presence emphasized only when a ticket is dispensed onto the surface of the input/output structure.

The orthogonal placement of the input/output ports also minimizes the need for vertical space within the gaming cabinet. For example, as illustrated in FIG. 5, the ticket printer 510 may be positioned parallel to a front inner wall of the gaming cabinet such that the first chute 520 is in alignment with the output port 410. The bill acceptor 530 may be positioned parallel to a side inner wall of the gaming cabinet such that the second chute 540 is in alignment with the input port 440. Because the ticket printer 510 is oriented at a 90-degree angle to the bill acceptor 530, these devices do not occupy the same horizontal space in the cabinet and, thus, need not be "stacked" as in prior art devices that co-locate the printer and bill acceptor output and input ports by, for example, using single input/output port.

Figure 6:
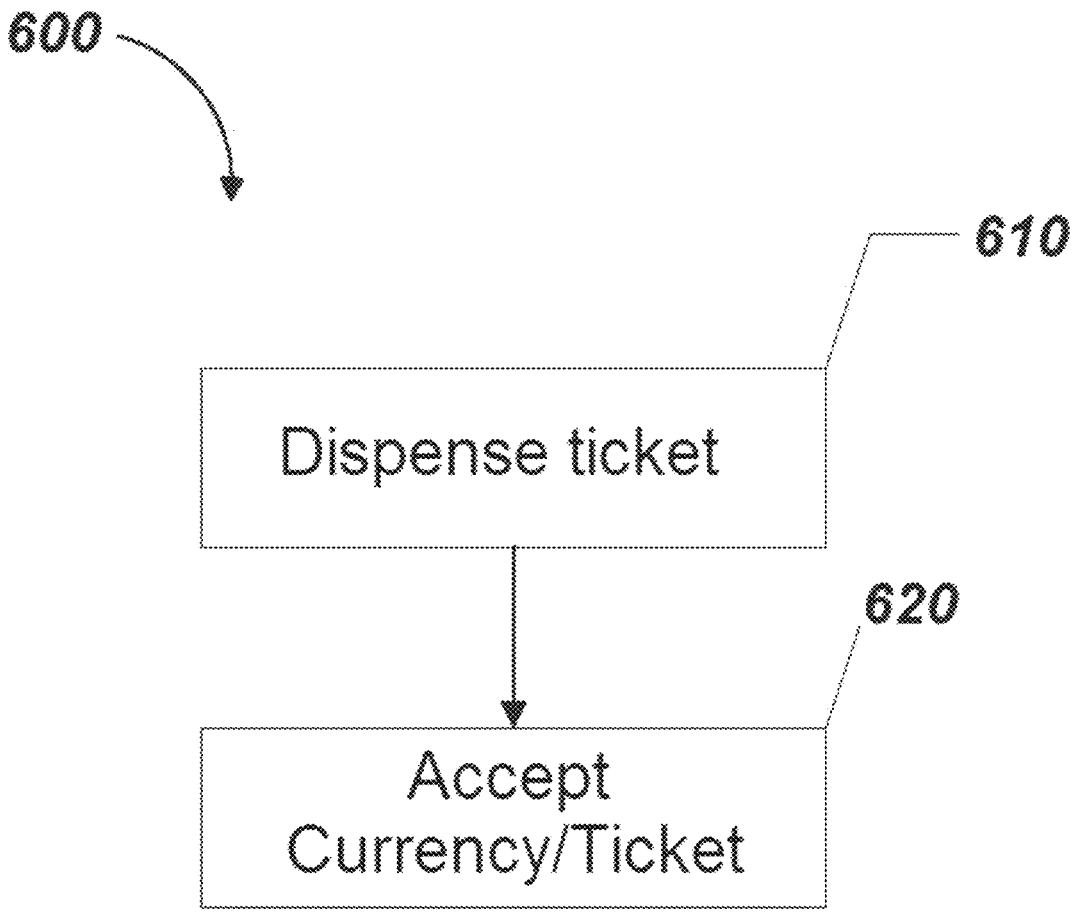
FIG. 6 is a flowchart for a method in accord with at least some aspects of the disclosed concepts.

FIG. 6 shows one example of a method 600 of using an input/output structure, the input/output structure including an elongated output port coupled to a first chute, and an elongated input port immediately adjacent and generally orthogonal to the output port and coupled to a second chute. At step 610, the method includes dispensing a ticket from the first chute through the output port and then onto a surface above the chute. At step 620, currency or a second ticket is accepted into the input port and then into the second chute.

FIG. 6, described by way of example above, represents one set of steps to perform the above described functions associated with the disclosed concepts. For example, only step 620 may be performed if a balance already exists on the gaming machine, for example, if credits were initially added by way of an electronic funds transfer. In another example, currency, tickets or both may be repeatedly inserted at step 610 without the performance of step 620, etc. For example, a player may insert cash several times and lose all of his money, eliminating the possibility of step 620.

Thus, each of these embodiments and obvious variations thereof is contemplated as falling within the spirit and scope of the claimed invention, which is set forth in the following claims. Moreover, the present concepts expressly include any and all combinations and sub-combinations of the preceding elements and aspects.

What is claimed is:

1. An input/output structure comprising:
first and second chutes disposed beneath a surface;
an elongated output port configured to dispense a first ticket from the first chute onto a surface; and
an elongated input port immediately adjacent and generally orthogonal to the output port and coupled to the second chute, the input port configured to accept and lead at least one of currency or a second ticket into the second chute.

2. The input/output structure of claim 1, wherein the surface forms an upward ramp extending from the output port.

3. The input/output structure of claim 1, wherein the output port and the surface are formed by a first component, and the input port and the chute are formed by a second component mounted within the first component.

4. The input/output structure of claim 1, wherein the first chute is adapted to mate with a ticket dispenser beneath the structure, and wherein the second chute is adapted to mate with a bill acceptor beneath the structure.

5. The input/output structure of claim 1, wherein second chute is curved downward to direct the at least one of the currency or the second ticket to a bill acceptor beneath the structure.

6. The input/output structure of claim 1, further including a cashout button mounted adjacent to the surface, wherein the first ticket is dispensed in response to pressing the cashout button.

7. A gaming device comprising:
a housing including a deck;
an electronic display mounted to the housing and configured to present a wagering game; and
an input/output structure mounted to the deck, the input/output structure including:
first and second chutes disposed beneath a surface generally parallel to the deck;
an elongated output port configured to dispense a first ticket from the first chute onto the surface; and
an elongated input port immediately adjacent to and generally orthogonal to the output port and coupled to the second chute, the input port configured to accept and lead at least one of currency or a second ticket into the second chute.

8. The gaming device of claim 7, wherein the surface forms an upward ramp extending from the output port.

9. The gaming device of claim 7, wherein the output port and the surface are formed by a first component, and the input port is formed by a second component mounted within the first component.

10. The gaming device of claim 7, wherein the first chute is adapted to mate with a ticket dispenser beneath the deck, and wherein the second chute is adapted to mate with a bill acceptor beneath the deck.

11. The gaming device of claim 7, wherein second chute is curved downward to direct the at least one of the currency or the second ticket to a bill acceptor beneath the deck.

12. The gaming device of claim 7, further including a cashout button mounted adjacent to the surface, wherein the first ticket is dispensed in response to pressing the cashout button.

13. The gaming device of claim 7, wherein the electronic display is mounted to the deck.

14. A method of using an input/output structure, the input/output structure including an elongated output port coupled to a first chute, and an elongated input port immediately adjacent and generally orthogonal to the output port and coupled to a second chute, the method comprising:

dispensing a first ticket from the first chute through the output port and then onto a surface above the chute; and accepting at least one of currency or a second ticket into the input port and then into the second chute.

15. The method of claim 14, wherein the surface forms an upward ramp extending from the output port.

16. The method of claim 14, wherein the output port and the surface are formed by a first component, and the input port is formed by a second component mounted within the first component.

17. The method of claim 14, wherein the first chute is adapted to mate with a ticket dispenser beneath the structure, wherein prior to the dispensing, the first chute directs the first ticket from the ticket dispenser to the output port; and wherein the second chute is adapted to mate with a bill acceptor beneath the structure and directs the at least one of the currency or the second ticket from the input port to the bill acceptor.

18. The method of claim 14, wherein second chute is curved downward to direct the at least one of the currency or the second ticket to a bill acceptor beneath the structure.

19. The method of claim 14, further including a cashout button mounted adjacent to the surface, and wherein the dispensing is responsive to pressing the cashout button.

* * * * *